US011584121B2

(12) United States Patent
Kearns et al.

(10) Patent No.: US 11,584,121 B2
(45) Date of Patent: Feb. 21, 2023

(54) INHIBITING MEDIA DEFORMATION

(71) Applicant: Hewlett-Packard Development Company, L.P., Spring, TX (US)

(72) Inventors: James Kearns, Corvallis, OR (US); Ron Burns, San Diego, CA (US); Craig LeVier, San Diego, CA (US); Leslie Caroline Drogo, San Diego, CA (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/051,106

(22) PCT Filed: Aug. 14, 2018

(86) PCT No.: PCT/US2018/046642
§ 371 (c)(1),
(2) Date: Oct. 27, 2020

(87) PCT Pub. No.: WO2020/036589
PCT Pub. Date: Feb. 20, 2020

(65) Prior Publication Data

US 2021/0252853 A1 Aug. 19, 2021

(51) Int. Cl.

| | |
|---|---|
| ***B41J 11/00*** | (2006.01) |
| ***B41M 5/00*** | (2006.01) |
| ***B41J 2/045*** | (2006.01) |

(52) U.S. Cl.
CPC ..... *B41J 2/04535* (2013.01); *B41J 2/04586* (2013.01); *B41J 11/0015* (2013.01); *B41M 5/0017* (2013.01)

(58) Field of Classification Search
CPC .. B41J 11/0005; B41J 11/0015; B41M 5/0017
See application file for complete search history.

(56) References Cited

U.S. PATENT DOCUMENTS

| | | | |
|---|---|---|---|
| 5,842,105 | A | 11/1998 | Acquaviva |
| 5,850,589 | A | 12/1998 | Cruz et al. |
| 7,460,824 | B2 | 12/2008 | Nakajima et al. |
| 7,748,816 | B2 | 7/2010 | Koase |
| 8,480,199 | B2 | 7/2013 | Chen et al. |
| 8,708,479 | B2 | 4/2014 | Link |

(Continued)

FOREIGN PATENT DOCUMENTS

| | | | |
|---|---|---|---|
| CN | 102378693 | B | 3/2012 |
| EP | 0787596 | A1 * | 6/1997 |

(Continued)

OTHER PUBLICATIONS

Maekawa, MachineTranslation of JP-2020006638-A, 2020 (Year: 2020).*
Tamaki, MachineTranslationofJP-2019116706-A, 2019 (Year: 2019).*

*Primary Examiner* — Scott A Richmond

(57) ABSTRACT

A deposition module within a web press for inhibiting media deformation may include a fluid deposition device located on a side of a media, and a processing device to control the fluid deposition device to selectively apply a wetting agent to the media. The deposition of the wetting agent may be based on the location of content printed on the media as defined by print data.

18 Claims, 13 Drawing Sheets

(56) References Cited

U.S. PATENT DOCUMENTS

| | | | | |
|---|---|---|---|---|
| 8,737,907 | B2 | 5/2014 | Hatazaki | |
| 9,193,177 | B1 | 11/2015 | LeFevre et al. | |
| 2004/0169696 | A1 | 9/2004 | Dietl | |
| 2009/0295893 | A1* | 12/2009 | Akiyama | B41M 5/0017 106/287.26 |
| 2010/0118066 | A1* | 5/2010 | Steed | B41J 29/393 347/21 |
| 2011/0193902 | A1 | 8/2011 | Yamanobe | |
| 2012/0127228 | A1 | 5/2012 | Chen et al. | |
| 2012/0194590 | A1 | 8/2012 | Suzuki | |
| 2014/0232783 | A1* | 8/2014 | del Rio | B41M 7/0018 347/21 |
| 2014/0292843 | A1 | 10/2014 | Fernandez Del Rio et al. | |
| 2016/0167401 | A1* | 6/2016 | Ebihara | B41J 11/0024 347/102 |
| 2017/0100943 | A1* | 4/2017 | Moore | D21H 23/30 |
| 2019/0193424 | A1* | 6/2019 | Tamaki | B41M 5/0017 |

FOREIGN PATENT DOCUMENTS

| | | | | | |
|---|---|---|---|---|---|
| EP | 0787596 | A1 | * | 8/1997 | B41J 11/0015 |
| GB | 2353761 | A | | 3/2001 | |
| JP | 2008-229980 | A | | 10/2008 | |
| JP | 2019116706 | A | * | 7/2019 | B41J 11/0015 |
| JP | 2020006638 | A | * | 1/2020 | |
| WO | 2017/095417 | A1 | | 6/2017 | |

* cited by examiner

INHIBITING MEDIA DEFORMATION

BACKGROUND

An inkjet web press is a high-speed, digital, industrial printing device that prints on a continuous media web at speeds of hundreds of feet per minute. A roll of media such as a paper on an unwinding device supplies the press with a web which is conveyed through the press along a media path. Stationary printheads along the media path may eject droplets of printing fluid onto the web to form images. The web may be conveyed through a drying area and out of the press through rollers to be rewound on a rewinding device.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
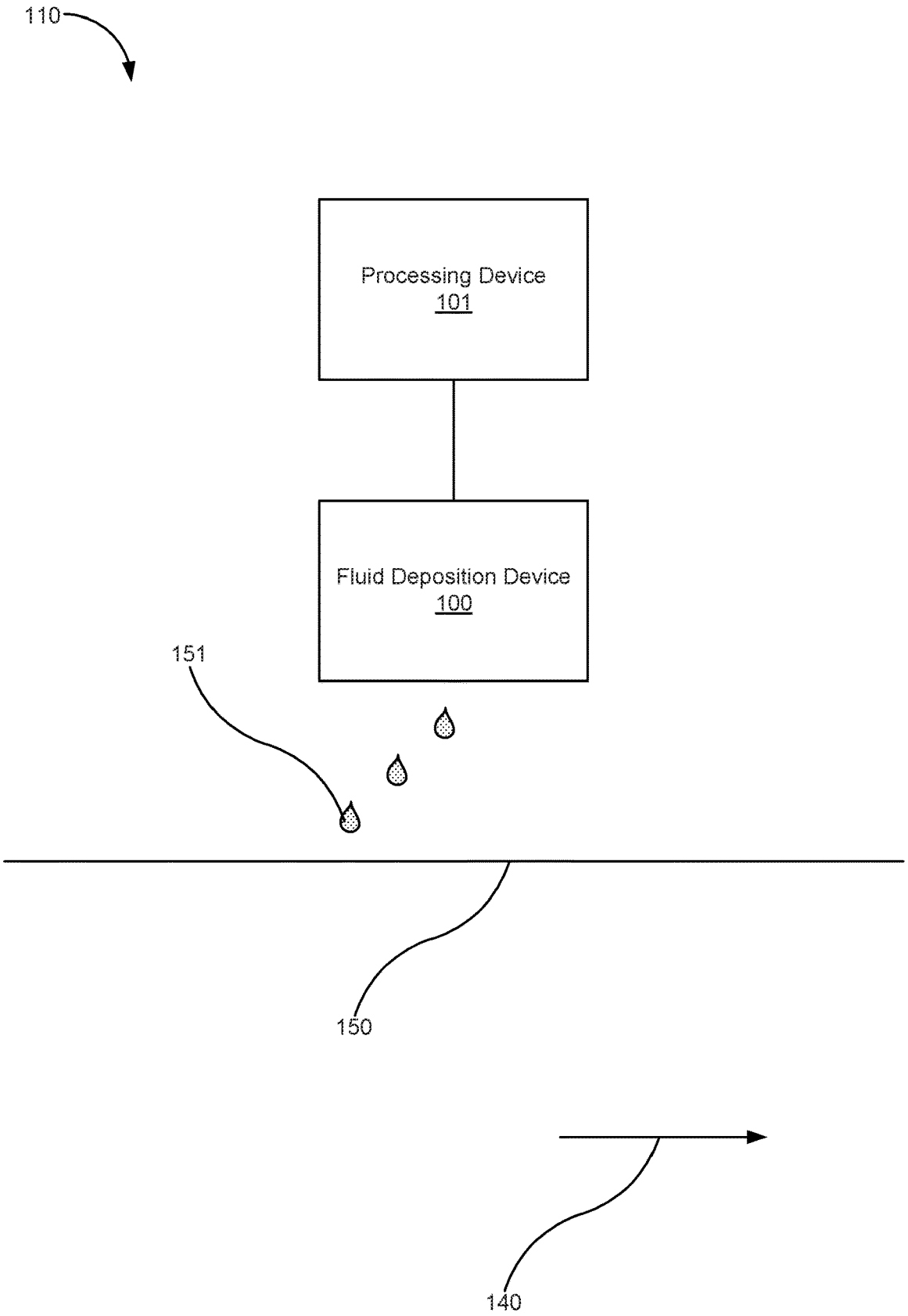
FIG. 1 is a block diagram of a deposition module within a web press for inhibiting media deformation, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Print fluid used in printing may include a significant amount of water that can saturate the web or other media that is being printed on. As this water is applied to the media, hydrogen bonds within the paper may be disassociated, and the fibers within the media may grow. Because printing is performed selectively where not all portions of the media is printed on and subjected to this fiber growth, a change in the stress strain profile of the paper occurs, and deformations within the media may form due to differential expansion along the length and width of the media. The moisture content of the web and tension along the media path within the press, among other factors, may cause the web to become deformed and produce media defects. Forms of deformation that may occur when the media is printed on may include curling, wrinkling, creasing, and other types of deformations within the media. Further, when there is significant variation across a printed media, or variation between the printed portions on the front and back of the media, it is possible that a variety of these deformations may occur. These deformations are due, at least in part, to different amounts of moisture content within the printing fluids such as inks or other fluids deposited on the media that causes the differential expansion along the length and width of the media.

Further, as the media subsequently dries, the drying may additionally affect the level of deformations within the media. For example, a first print job may include a book in which one side of a page is a line drawing or light text, and the backside is a solid area fill. In another example, a second print job may include a top liner for a corrugate product in which there is a box being printed with heavy printed content on the sides of the box, and relatively little to no content on the bottom of the box, which would form a 'ring' shape of heavy content. In the first print job, to balance the heavy content, it may be desirable to add moisture on the opposite side of the heavy content to inhibit curl. In the second print job, it may be desirable to add moisture to the same side to inhibit media puckering and wrinkling. In both examples, the technique of adding moisture assists in reducing or eliminating differential expansion of the media.

Examples described herein provide a deposition module within a web press for inhibiting media deformation. The deposition module may include a fluid deposition device located on a side of a media, and a processing device to control the fluid deposition device to selectively apply a wetting agent to the media. The deposition of the wetting agent may be based on the location of content printed on the media as defined by print data.

The fluid deposition device includes two fluid deposition devices. The fluid deposition devices are located on opposite sides of the media. The processing device controls the fluid deposition device to selectively apply the wetting agent to portions of the media where the content is not printed on the media. The processing device controls the fluid deposition device to selectively apply the wetting agent to portions of the media where the content is not printed on the media and where the content is printed on the media. The amount of wetting agent deposited on the media where the content is not printed is different from the amount of the wetting agent where the content is printed. The fluid deposition device may be a thermal inkjet printhead or a piezoelectric printhead. The processing device controls the fluid deposition device to selectively apply the wetting agent to portions of the media based on blooming where the content is and is not printed as defined by the print data.

Examples described herein provide a system for inhibiting media deformation. Inhibiting deformation in the media includes reducing to any level the curling, wrinkling, creasing, and other types of deformations in the media up to and including preventing or eliminating such deformations. The examples described herein allows for the management of the deformation in a way that allows for dimensional expansion in the media, while managing the deformations.

The system may include a web press. The web press may include an inkjet printhead and a fluid deposition device located on a side of a media to deposit a wetting agent onto a media. The system may also include a processing device to control the fluid deposition device to selectively apply the wetting agent to the media based on the location of content printed on the media as defined by print data. The processing device controls the fluid deposition device to selectively apply the wetting agent to portions of the media where the content is not printed on the media and where the content is printed on the media. The amount of wetting agent deposited on the media where the content is not printed is different from the amount of the wetting agent where the content is printed. The processing device controls the fluid deposition device to apply the wetting agent to a whole frame as defined by the print data. The processing device controls the fluid deposition device to selectively apply the wetting agent to portions of the media where the content is not printed on the media and where the content is printed on the media.

The amount of the wetting agent dispensed by the fluid deposition device is variable. The system may include a deposition mode selection module to, when executed by the processing device, select a wetting agent deposition mode based on print data. The system may include a wetting agent selection module to select a wetting agent for deposition.

Examples described herein provide a method of inhibiting media deformation. The method may include determining positions on a media at which a wetting agent is to be deposited based on the location of content printed on the media as defined by print data, and, with a fluid deposition device of a printing device, depositing the wetting agent on the media based on a deposition mode of the wetting agent. The method may include determining from the intended printed content whether the media is susceptible to media deformation, and selecting the deposition mode of the wetting agent based on the determination as to whether the media is susceptible to media deformation.

Turning now to the figures, FIG. 1 is a block diagram of a deposition module (110) within a web press for inhibiting media deformation, according to an example of the principles described herein. The deposition module (110) may be a device capable of depositing fluid (151) onto a media (150) such as, for example, a printhead such as those printheads used to print printing fluid onto the media (150). In this example, the deposition module (110) may be located alongside a number of ink printheads that are used to print images and text onto the media (150).

The deposition module (110) may include at least one fluid deposition device (100) that is the device within the deposition module (150) that is activated to deposit fluid (151) onto the media (150). Examples of fluid deposition device (100) include thermal ejection devices, piezoelectrical ejection devices, and other types of fluid ejection devices. As the media (150) travels along a print path in the direction of arrow 140, the fluid deposition device (100) deposits the fluid (151) onto the media (150) as instructed by the processing device (101).

The fluid (151) deposited by the fluid deposition device (100) may include any colorless fluid that may inhibit, reduce, or prevent deformations when ink is printed onto the media (150). In one example, the fluid (151) may be a precursor that conditions the medium surface prior to application of one or more colorants to the recording medium surface of the media. Thus, as defined herein, the term "wetting agent," "bonding agent," "fixing fluid," "fixer," or similar terms as used in the present specification and in the appended claims is meant to be understood broadly as any fluid that chemically, electrically, or otherwise physically inhibits, reduces, or prevents deformations when ink is printed onto the media (150).

In an example, the wetting agent (151) may include a large proportion of water to assist in the ejection of the wetting agent (151) from the fluid deposition device (100). For example, the water in the wetting agent (151) may assist in a thermal inkjet process in examples where the fluid deposition device (100) is a thermal inkjet printhead. The water component within the wetting agent (151) relaxes the media (150) to inhibit the curling of the media (150). The wetting agent (151) may also include chemical substances used to keep the fluid deposition device (100) healthy as to its ability to eject the wetting agent (151), and may also include a salt to crash the pigments deposited by the printhead (152) during printing.

The deposition module (110) also includes a processing device (101) to control the fluid deposition device (100) to selectively apply a wetting agent (151) to the media. The processing device (101) may be any device that provides print data to the fluid deposition device (100) that defines where ink is to be printed to the media (150). The processing device (101) may use the print data to allow the fluid deposition device (100) to print the wetting agent (151) at portions of the media (150) where ink is to be printed, at portions of the media (150) where the ink is not to be printed such as background portions, throughout an entirety of the media (150), at varying portions of the media (150), at varying amounts or gradients of the wetting agent (151), and combinations thereof. In this manner, the deposition of the wetting agent may be based on the location of content printed on the media (150) as defined by the print data supplied to the processing device (101).

The deposition module (110) allows for the inhibition, reduction, or prevention of deformation of the media by selectively printing or not printing the wetting agent (151) under the printed content and not at other locations, in the background and not under the printed content, as a flood coat, and with the ability to set different levels of fixer being deposited under content and in the background. Further, as described herein, by leveraging the print data by performing additional processing on the print data in the processing device, the deposition module (110) does not require the use of additional color plane data from a digital front end (DFE) or additional print bars on the web press in which the deposition module (110) is included. This, in turn, allows an operator to execute print jobs that maximize the resources (such as memory, bandwidth or processing speed) of the processing module. If a separate plane was used, additional hardware may be used to maintain the performance of the printing device, or the operator may be forced to slow down the printing process.

Figure 2:
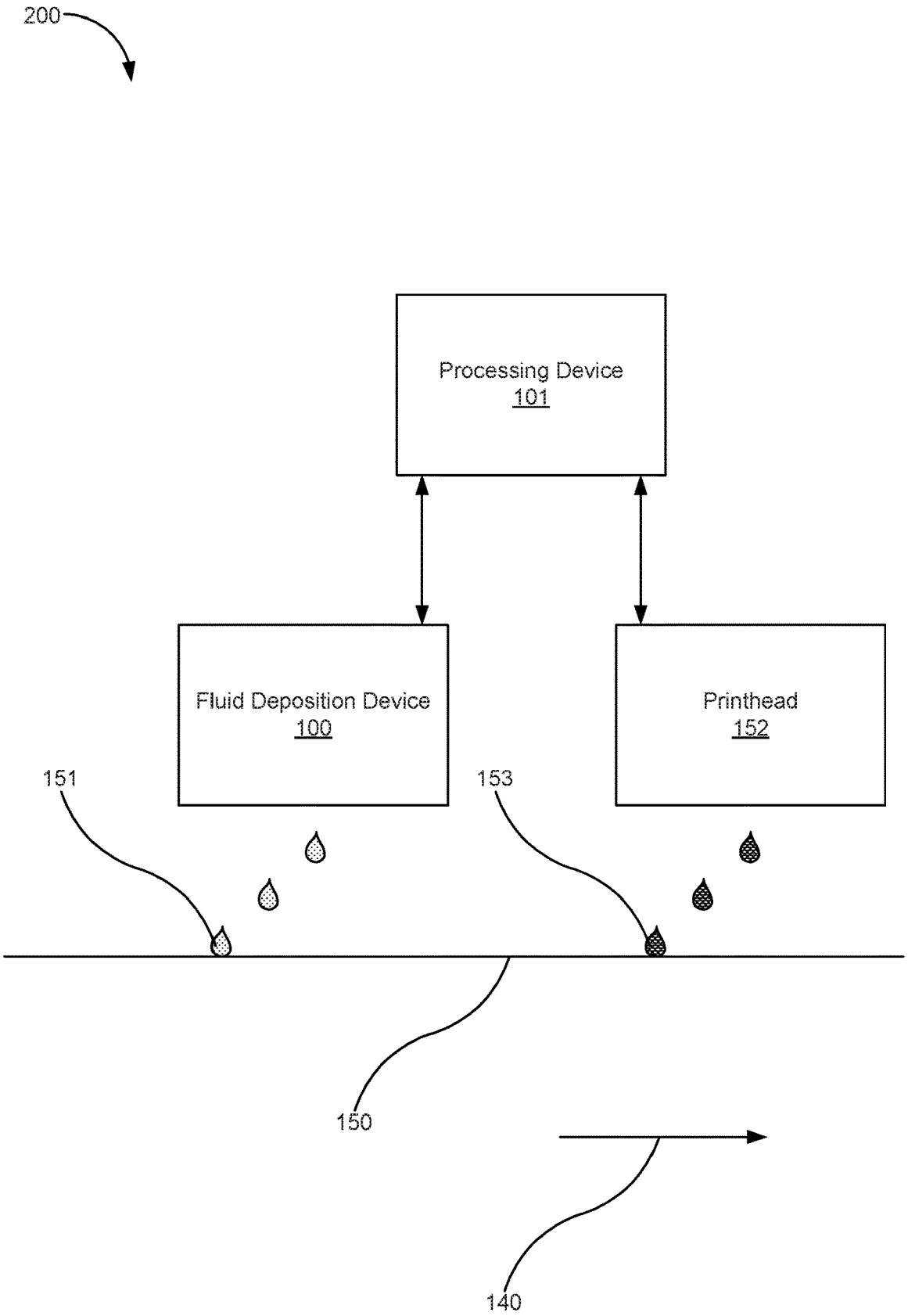
FIG. 2 is a block diagram of a deposition module within a web press for inhibiting media deformation, according to an example of the principles described herein.

FIG. 2 is a block diagram of a deposition module (200) within a web press for inhibiting media (150) deformation, according to an example of the principles described herein. The systems and methods of inhibition of deformations in the media (150) allow for dimensional expansion along the surface of the media (150) through application of the wetting agent (151) and/or a printing fluid (153), but ensures that deformations do not occur despite the application of the wetting agent (151) and/or a printing fluid (153). The deposition module (200) of FIG. 2 includes similar elements as described in connection with FIG. 1 herein, and description of those elements is provided in connection with FIG. 1. The deposition module (200) also includes a printhead (152) that deposits printing fluid (153) such as an ink onto the media (150) after the fluid deposition device (100) has deposited the wetting agent (151) onto the media (150). The processing device (101) may control the deposition of the printing fluid (153) as well as the deposition of the wetting agent (151) onto the media (150) based on the print data supplied to the processing device (101). Although one printhead (152) is depicted in FIG. 2, any number of printheads (152) may be included within the deposition module (200) to allow any number of colors to be printed to the media (150).

Figure 3:
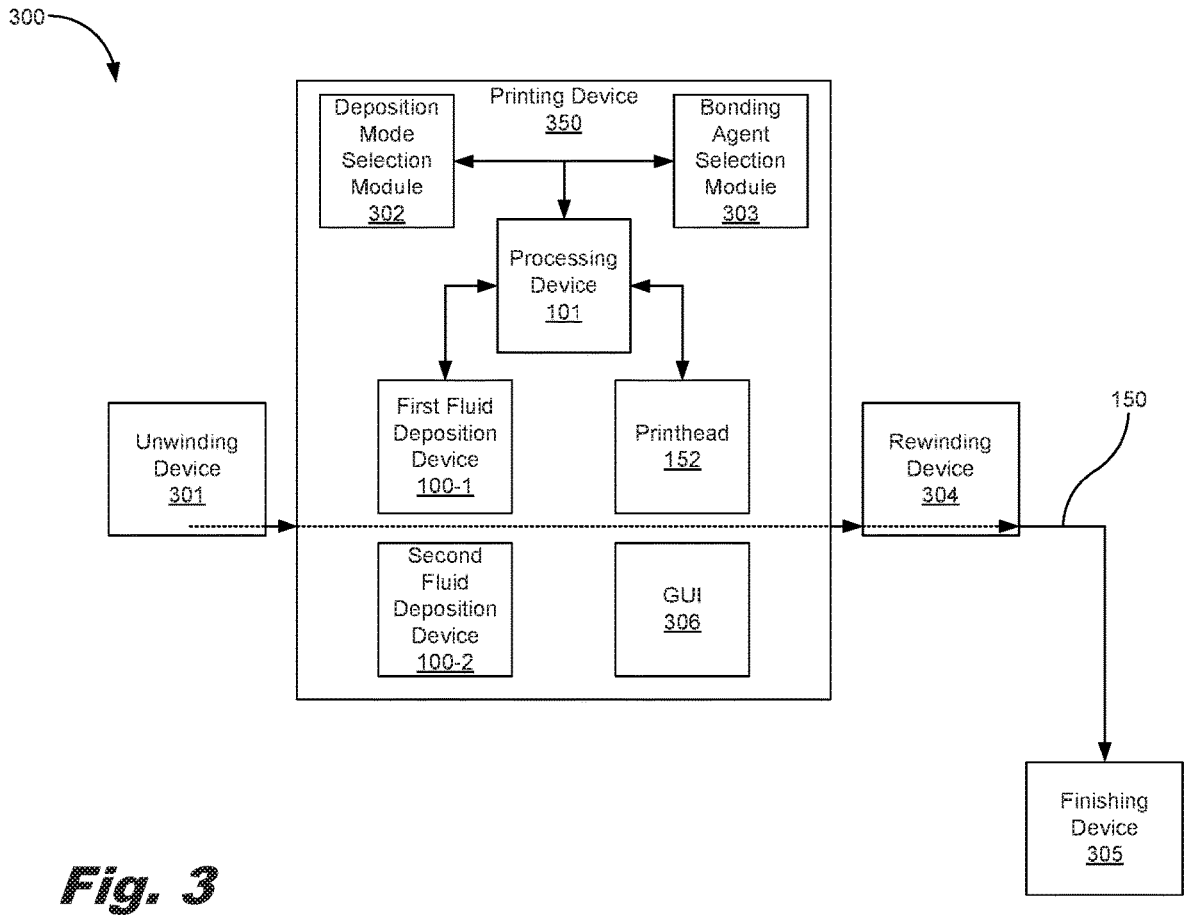
FIG. 3 is a block diagram of a system for inhibiting media deformation, according to an example of the principles described herein.

FIG. 3 is a block diagram of a system (300) for inhibiting media (150) deformation, according to an example of the principles described herein. In one example, the system may be or include a web press. The system (300) may include an unwinding device (301). The unwinding device (301) includes a spool of print media web, and may be spooled out to through a printing device (350) for deposition of the wetting agent (151) and printing fluid (153). The system (300) may also include a rewinding device (304). The rewinding device (304) is used to collect the printed-on web (150) onto a spool much like the web (150) existed as it sat on the unwinding device (301) before the web (150) was unspooled from the unwinding device (301). Further, the system (300) may also include a number of finishing devices (305). The finishing device (305) may be located between the printing device and the rewinding device (304), or may be in place of the rewinding device (304) to perform at least one post-printing operation on the media (150). Post-printing operations performed by the finishing device (305) may include, for example, cutting, folding, collating, packaging, other finishing processes, or combinations thereof.

The printing device (350) of the system (300) of FIG. 3 may include the processing device (101) and printhead (152) described herein. Further, the printing device (350) may include a first fluid deposition device (100-1) and a second fluid deposition device (100-2) located on opposite sides of the media (150). In some examples, the wetting agent (151) may be deposited on both sides of the media (150) by activation of the first fluid deposition device (100-1) and the second fluid deposition device (100-2) positioned in this manner relative to the media (150). For example, if the media (150) is being printed in duplex where content is printed on both sides of the media (150), the wetting agent (151) may be printed on both sides of the media (150) along with the printed content in order to inhibit the deformation of the media (150) as ink is applied to both sides. Further, in examples, where one side is to be printed heavily with content including text and/or images with little or no content printed on the other side, the wetting agent (151) may be applied to the side with little or no content printed thereon. In these examples, the wetting agent (151) may be applied to portions of one or both sides of the media (150) to inhibit differential expansion of the media (150) that leads to the types of deformation of the media (150) described herein. As the media (150) dries, the differential expansion caused by the application of a printing fluid causes the media (150) to become deformed. The application of the wetting agent (151) as described herein inhibits this deformation by counteracting the effects of the differential expansion caused by the application of a printing fluid.

The printing device (350) may also include a number of modules used in the implementation of wetting agent (151) application to the media (150) to inhibit deformations in the media (150). The various modules within the printing device (350) include executable program code that may be executed separately. In this example, the various modules may be stored as separate computer program products. In another example, the various modules within the printing device (350) may be combined within a number of computer program products; each computer program product comprising a number of the modules.

The printing device (350) may include a deposition mode selection module (302) to, when executed by the processing device (101), allow for the automatic selection and/or user-selection of a mode of wetting agent (151) deposition. The modes of deposition of the wetting agent (151) include, for example, application of the wetting agent (151) under printed portions of the media (150), application of the wetting agent (151) in portions of the media (150) where the printed portions are do not exist, flood coating of the wetting agent (151), application of the wetting agent (151) under printed portions of the media (150) using blooming function, application of the wetting agent (151) under printed portions of the media (150) using a blooming function, varying the amounts of wetting agent (151) applied to the media (150) in any of the above examples, other wetting agent (151) deposition modes, and combinations thereof.

Figure 4:
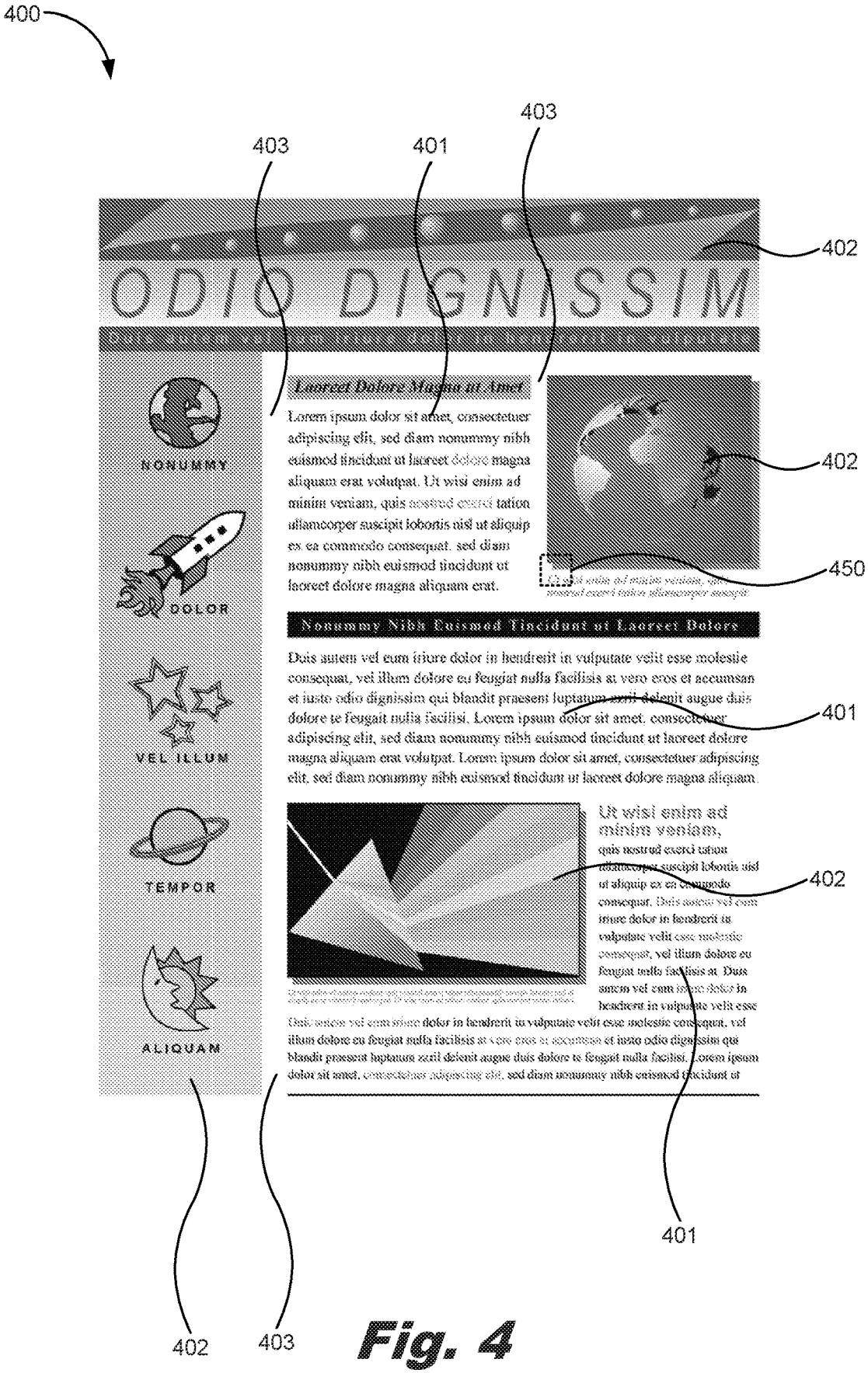
FIG. 4 is a diagram of a document for application of a wetting agent, according to an example of the principles described herein.
Figure 5:
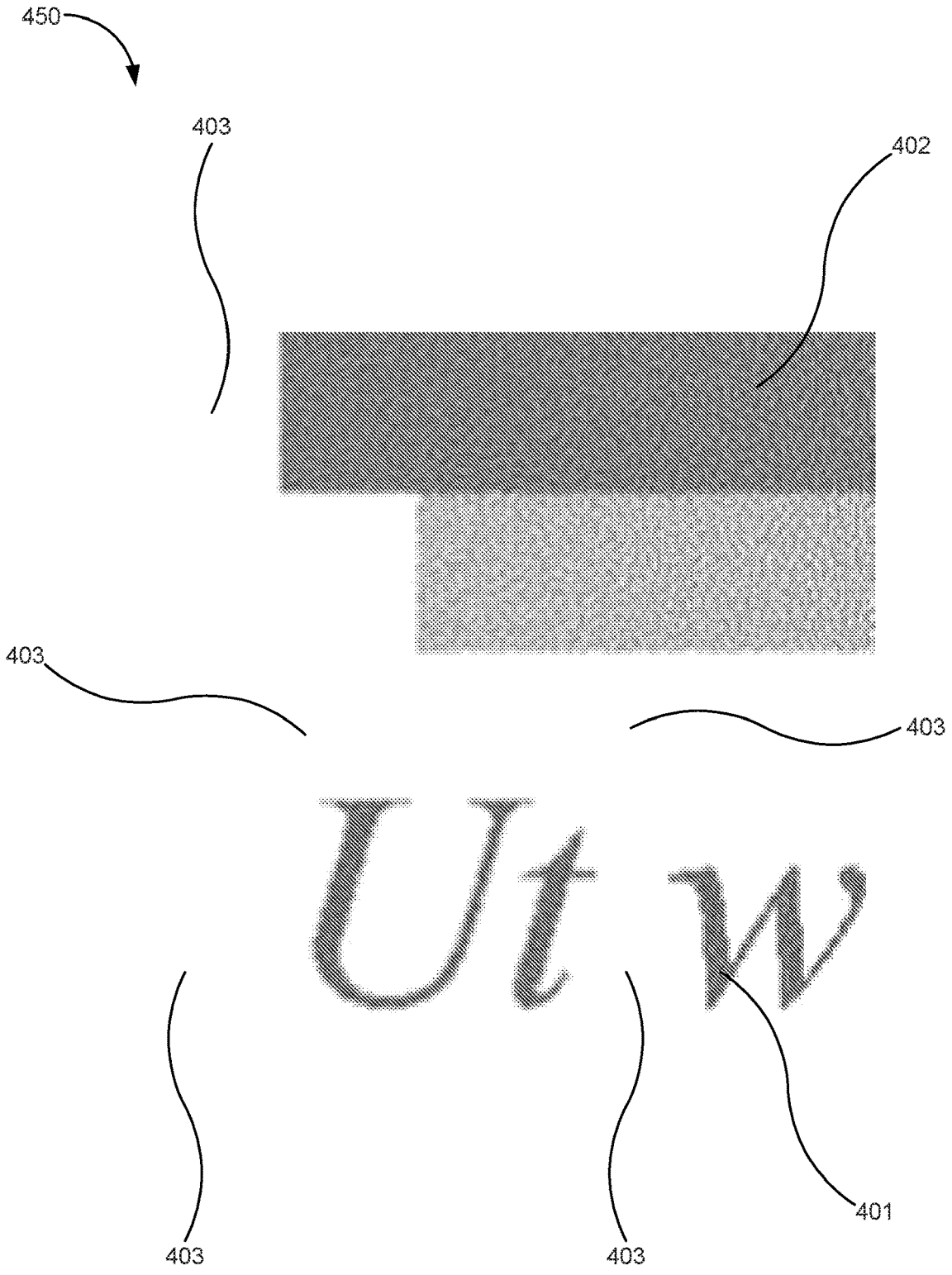
FIG. 5 is a diagram of a portion of the document of FIG. 4, according to an example of the principles described herein.

In some examples, the application of the wetting agent (151) to the media (150) may not be beneficial to inhibiting deformation of the media (150). In this example, the wetting agent (151) is not applied to the media (150) before printing. FIGS. 4 and 5 depict a scenario where no wetting agent (151) is applied to the media (150). Specifically, FIG. 4 is a diagram of a document (400) for application of the wetting agent (151), according to an example of the principles described herein, and FIG. 5 is a diagram of a portion of the document (400) of FIG. 4, according to an example of the principles described herein. The document (400) of FIGS. 4 and 5, as well as documents depicted in FIGS. 6 through 11, are dummy text and graphics documents that demonstrate the visual form of a document without relying on meaningful content (i.e., greeking) by replacing actual content with placeholder text and graphics. Thus, document (400) of FIGS. 4 and 5, as well as the documents depicted in FIGS. 6 through 11, may include text portions (401) where text is included in the document (400), and graphics portions (402) where graphics are included in the document (400). Further, the document (400) may include a number of spaces (403) between the text portions (401) and graphics portions (402).

In the case of FIGS. 4 and 5, no wetting agent (151) has been applied to the dummy text document (400). Section 450 of FIG. 4 is depicted in FIG. 5 and includes details of the both text portions (401) and graphics portions (402). FIGS. 4 and 5 may be used by way of comparison relative to FIGS. 6 through 11 as to how the wetting agent (151) is applied to the dummy text document (400). The different types of wetting agent (151) deposition that are available as selectable modes by the deposition mode selection module (302) will now be described in more detail.

Figure 6:
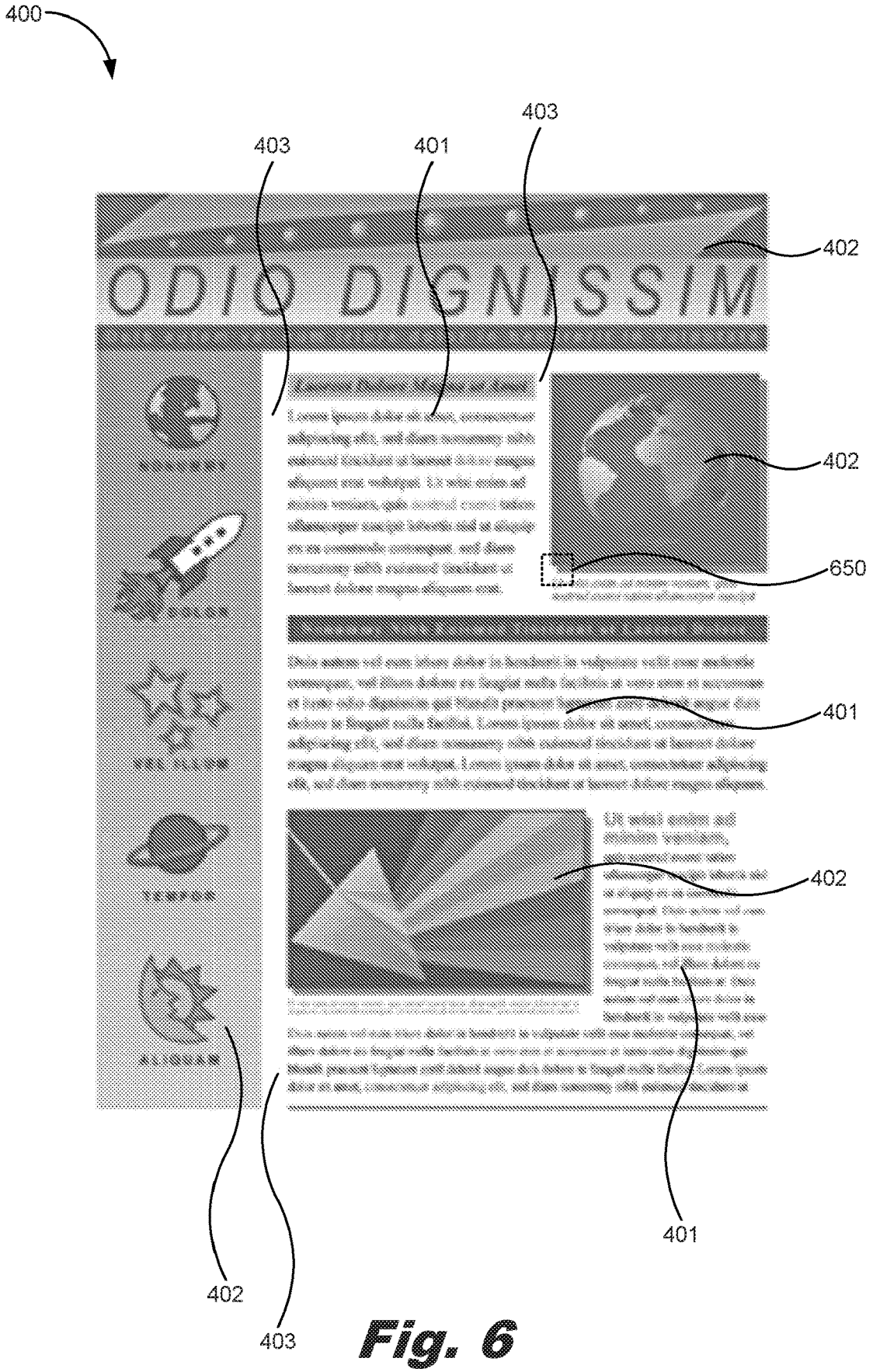
FIG. 6 is a diagram of the document of FIG. 4 including a wetting agent applied under printed portions of the document, according to an example of the principles described herein.
Figure 7:
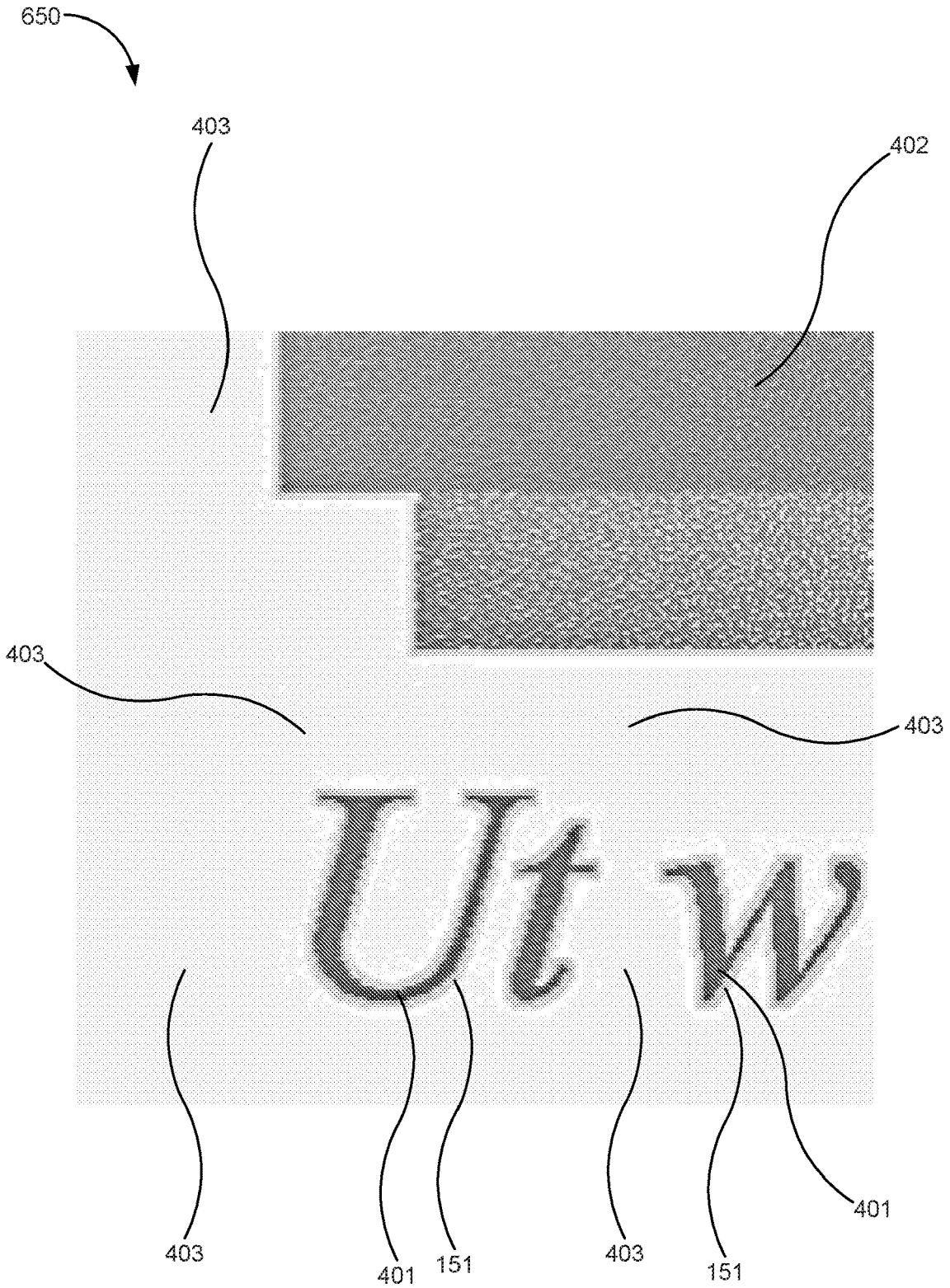
FIG. 7 is a diagram of a portion of the document of FIG. 6, according to an example of the principles described herein.

A first mode may include depositing the wetting agent (151) under the printed portions of the document (400) as depicted in FIGS. 6 and 7. FIG. 6 is a diagram of the document (400) of FIG. 4 including the wetting agent (151) applied under printed portions (401, 402) of the document (400), according to an example of the principles described herein. FIG. 7 is a diagram of a portion (650) of the document (400) of FIG. 6, according to an example of the principles described herein. The wetting agent (151) may be deposited by the processing device (101) executing the deposition mode selection module (302) and controlling the first fluid deposition device (100-1) and/or the second fluid deposition device (100-2) to deposit the wetting agent (151) onto the media (150).

The wetting agent (151) may be deposited based on print data supplied to the processing device (101) and controlling the digitally addressable fluid deposition devices (100-1, 100-2) to deposit the wetting agent (151) onto portions where the text portions (401) and the graphics portions (402) of the document (400) are to be printed by the printhead (152). As depicted in FIG. 7, the wetting agent (151) is depicted as a being deposited below the text portion (401) and a graphics portion (402) as indicated by the silhouette around the text of the text portion (401) and the graphics of the graphics portion (402).

In the example of FIGS. 6 and 7, the wetting agent (151) may be deposited directly underneath the text portion (401) and a graphics portion (402), or a blooming function may be executed by the processing device (101) to expand the area of deposition of the wetting agent (151) around where the printing fluid (153) is to be deposited by the printhead (152). When using the blooming function, the processing device (101) is able to expand the area under the text portions (401) and a graphics portions (402) of the document so that any errors in the deposition of the printing fluid (153) will not result in the printing fluid (153) being deposited on a portion of the document (140) that is not covered by the wetting agent (151). It is noted that the wetting agent (151) in FIGS. 6 and 7 is not deposited in the spaces (403) between the text portions (401) and graphics portions (402). By not depositing the wetting agent (151) in the spaces (403), the wetting agent (151) is not overconsumed or overused, resulting in less expensive print job for the user.

Figure 8:
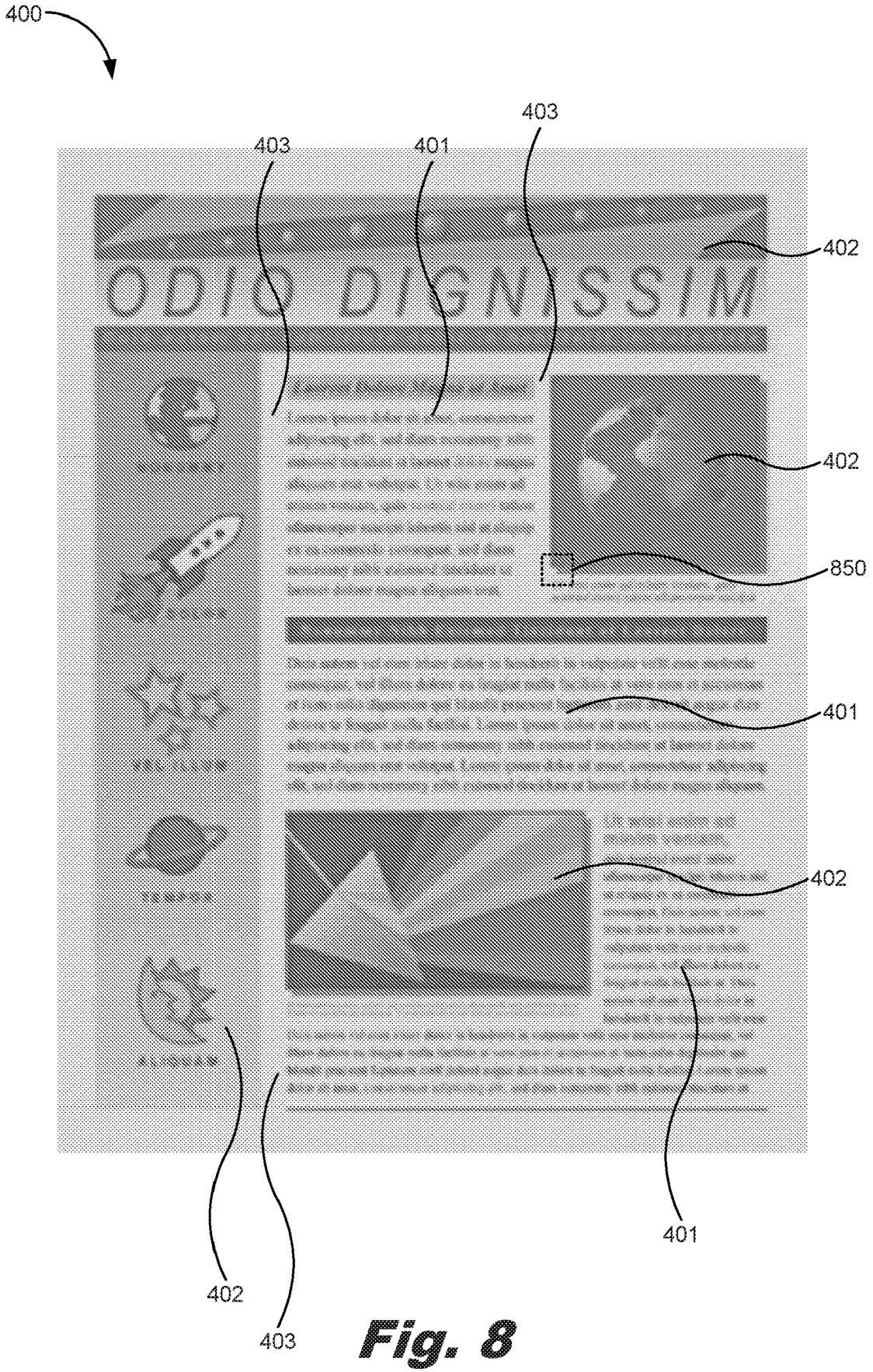
FIG. 8 is a diagram of the document of FIG. 4 including a wetting agent applied in a flooded manner across the document, according to an example of the principles described herein.
Figure 9:
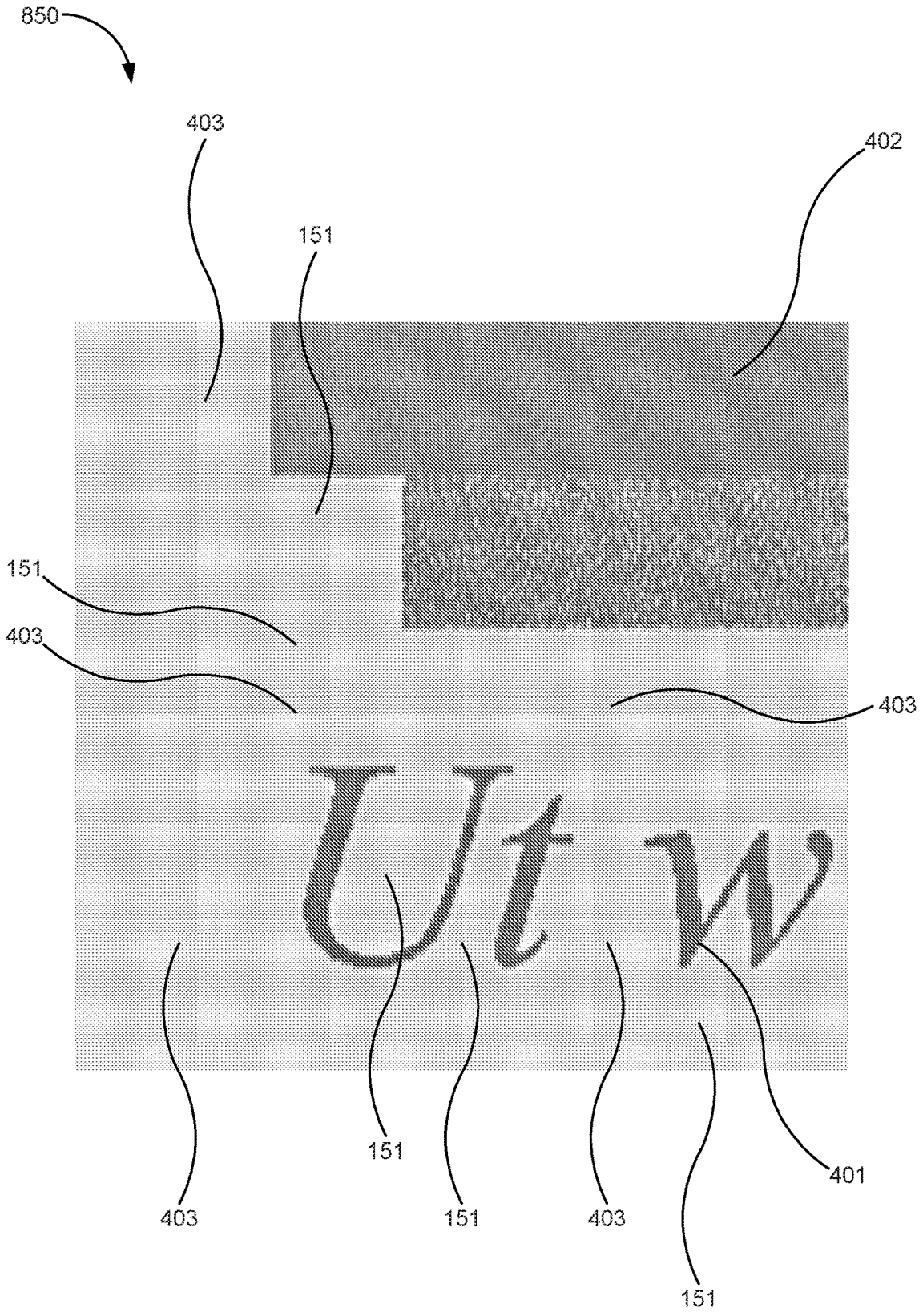
FIG. 9 is a diagram of a portion of the document of FIG. 8, according to an example of the principles described herein.

A second mode of wetting agent (151) deposition may include depositing the wetting agent (151) in a flood coat where the wetting agent (151) is deposited on the whole frame of the media (150). FIG. 8 is a diagram of the document (400) of FIG. 4 including a wetting agent (151) applied in a flooded manner across the document (400), according to an example of the principles described herein. Further, FIG. 9 is a diagram of a portion of the document (400) of FIG. 8, according to an example of the principles described herein. As depicted in FIGS. 8 and 9 as compared to, for example, FIGS. 4 and 5, the wetting agent (151) is deposited under the text portions (401) and graphics portions (402) as well as in the spaces (403) between the text portions (401) and graphics portions (402). By depositing wetting agent (151) throughout the entirety of the frame of the media (150) in which the text portions (401) and graphics portions (402) are to be printed, deformations may not be formed since the entirety of the frame of the media (150) has been relaxed by the wetting agent (151) and will dry at approximately the same rate such that the deformations will not form.

As an example of flood coating of the wetting agent (151), a variable flood coat of the wetting agent (151) may be applied to the media (150). In this example, a configurable and relatively different amount of wetting agent (151) may be deposited under the text portions (401), the graphics portions (402), and the spaces (403) between the text portions (401) and graphics portions (402). For example, a least amount of wetting agent (151) may be deposited at areas of the media (150) where the graphics portions (402) are to be printed, a relatively greater amount of wetting agent (151) may be deposited at areas of the media (150) where the text portions (401) are to printed, and a relatively greatest amount of wetting agent (151) may be deposited at areas of the media (150) where the spaces (403) exists.

In this example, the amount of wetting agent (151) applied in the spaces (403) may be considered a baseline 100%. The amount of wetting agent (151) applied under the text portions (401) may be less than 100% of the amount of wetting agent (151) applied at the spaces (403) but greater than the percentage of wetting agent (151) applied under the graphics portions (402), and the amount of wetting agent (151) applied under the graphics portions (402) may be less than the percentage of wetting agent (151) deposited under the text portions (401). By varying the amount of wetting agent (151) applied in a flooded manner along the entirety of the media (150) provides flexibility to mitigate the cost to the user for deposition of the wetting agent (151) in the printed document while providing flexibility to choose a solution that inhibits deformation in the media (150) most effectively.

Figure 10:
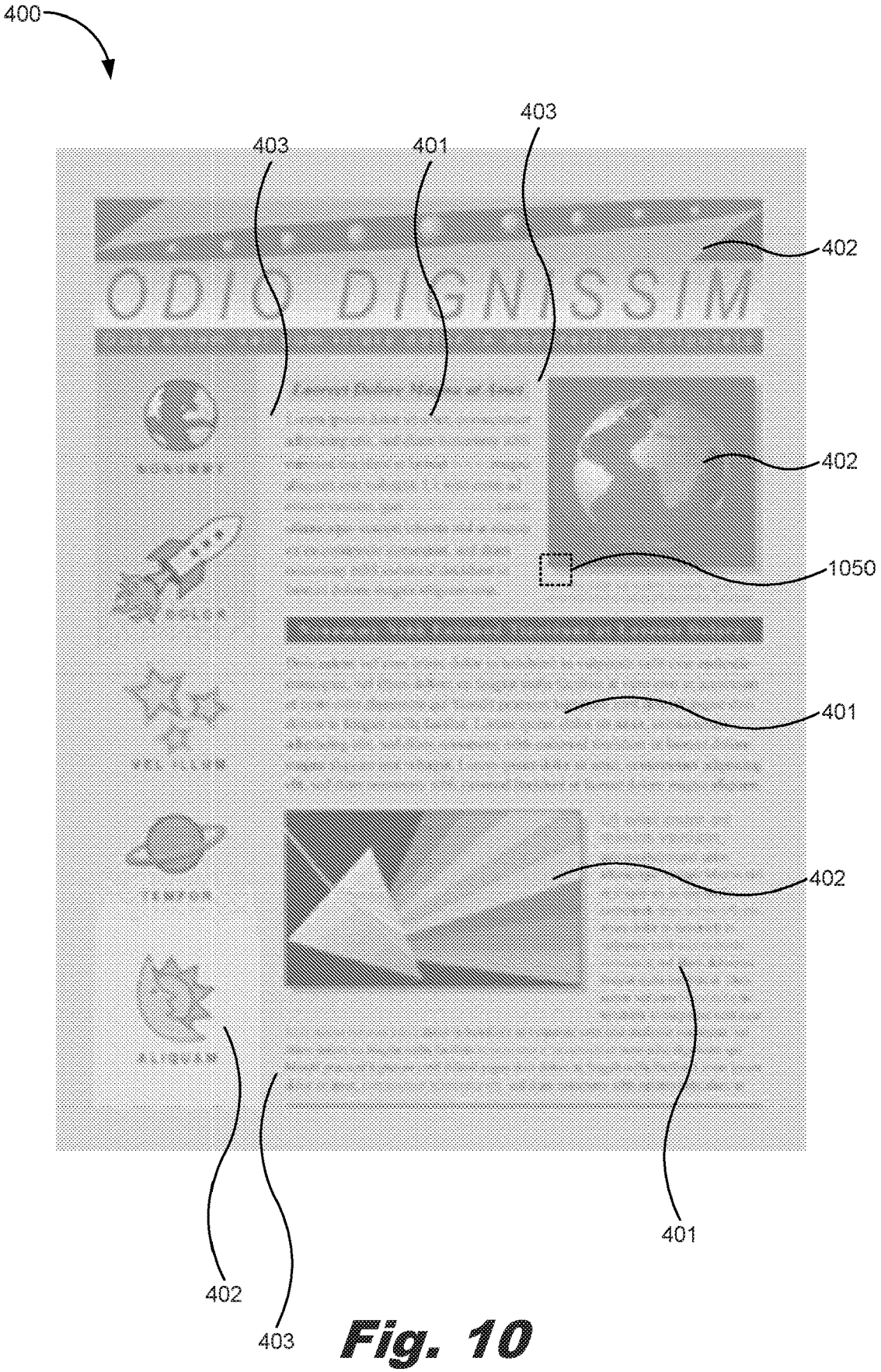
FIG. 10 is a diagram of the document of FIG. 4 including a wetting agent applied to background portions of the document, according to an example of the principles described herein.
Figure 11:
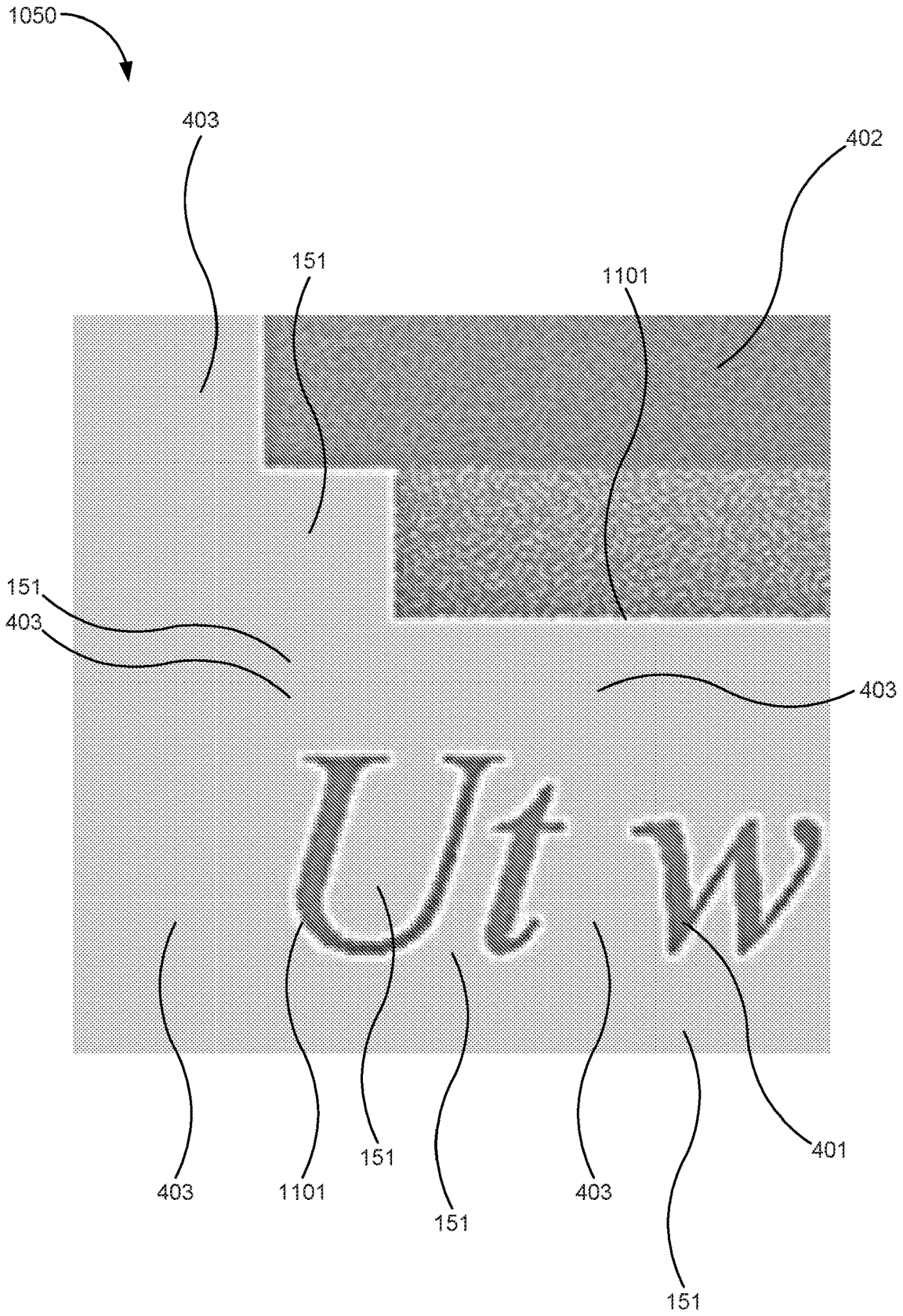
FIG. 11 is a diagram of a portion of the document of FIG. 10, according to an example of the principles described herein.

A third mode of wetting agent (151) deposition may include depositing the wetting agent (151) as a background coating where the wetting agent (151) is applied to background areas where text and graphics are not printed on the media (150). In other words, in the example of FIGS. 10 and 11, the wetting agent (151) is deposited on the spaces (403) between the text portions (401) and graphics portions (402). FIG. 10 is a diagram of the document (400) of FIG. 4 including a wetting agent (151) applied to background portions (403) of the document (403), according to an example of the principles described herein. FIG. 11 is a diagram of a portion of the document (400) of FIG. 10, according to an example of the principles described herein. In order to derive data defining where the wetting agent (151) is to be deposited in the example of FIGS. 10 and 11, in one example, the processor (101) may execute an inverted blooming function.

As described herein, when using a blooming function, the processing device (101) is able to expand the area under the text portions (401) and a graphics portions (402) of the document (400). The inverted blooming function takes the results of the blooming function, inverts the data, and produces wetting agent (151) deposition data based on the inverted data. In this manner, the spaces (403) between the text portions (401) and graphics portions (402) (i.e., the background) within the document (400) may be coated with the wetting agent (151). As depicted in FIG. 11, the wetting agent (151) is depicted as a being deposited around the text portion (401) and a graphics portion (402) as indicated by the silhouette (1101) around the text of the text portion (401) and the graphics of the graphics portion (402). The silhouette (1101) is the opposite of the silhouette described above in connection with FIG. 7 in that the silhouette depicted in FIG. 7 indicates where wetting agent (151) is deposited next to the text portions (401) and the graphics portions (402), whereas the silhouette (1101) around the text portions (401) and the graphics portions (402) depicted in FIG. 11 indicate where wetting agent (151) is not deposited due to the application of the inverted blooming function.

The example of FIGS. 10 and 11 leverages the blooming function by inverting bloomed data to create a depleted background fill so that the text portions (401) and graphics portions (402) are not likely to encounter the wetting agent (151) and create an unwanted image effect when printing occurs. In one example, the instead of executing an inverted blooming function to obtain the background fill as depicted in FIGS. 10 and 11, the print data may be pre-warped, and a depletion function may be executed by the processing device (101). Other methods of obtaining data defining the spaces (403) between the text portions (401) and graphics portions (402) (i.e., background data) may be used.

Use of the modes of wetting agent (151) deposition described in connection with FIGS. 4 through 11 allows users to improve output quality of the printing device (350) by giving users the ability to select the quantity of the wetting agent (151) and the level of application such as flood coating, background coating, deposition under text, deposition under graphics, variable deposition, and combinations thereof, that best showcases their printed product while mitigating the printed defects caused by differential expansion of the media.

In the modes of wetting agent (151) deposition described in connection with FIGS. 4 through 11, the pre-calculated color planes used to instruct the printhead (152) to deposit printing fluid (153) onto the media (150) may be leveraged to re-map the print data to provide wetting agent deposition planes for use by the fluid deposition devices (100, 100-1, 100-2) within the printing device (350). Use of existing color planes in this way significantly reduces processing time of the printing device (350) and allows the printing device (350) to implement the systems and methods described herein with any set of print data provided to the printing device (350).

In one example, remapping the print data may include the backend of the print pipeline of the printing device (350) to have information as to what mode of wetting agent (151) deposition is selected. The printing device (350) may remap the data to output data in a masking or mapping process to choose the amount of wetting agent (151) such as a number of drops deposited by the fluid deposition devices (100, 100-1, 100-2). Incoming print data may be mapped to a printed output drop. In this example, the mapping may be changed so that the print data may be warped to no output, no print data to a printed output, or combinations thereof. This warping may be performed by software, or in hardware such as in a field-programmable gate array (FPGA), or combinations thereof. In one example, of an efficient implementation is through the use of a look-up table (LUT).

In one example, certain areas or portions of the media (150) may not be selected for deposition of the wetting agent (151) or printing fluid (153). These areas or portions may include, for example, margins of the document. Not depositing wetting agent (151) or printing fluid (153) in these areas or portions ensure that the wetting agent (151) is not wasted on these areas that are not of consequence in printing the document.

Turning again to FIG. 3, the printing device may also include a wetting agent selection module (303) and a graphic user interface (GUI) (306) along with the deposition mode selection module (302). The processing device (101) may execute the wetting agent selection module (303) to present on the GUI (306) a number of user-selectable options such as the type of media (150) being printed on, a desired mode of wetting agent (151) deposition, and a desired type of wetting agent. In this example, the user may make a selection, and the printing device (350) may deposit the wetting agent (151) and printing fluid (153) onto the media (150) according to the user's selections. For example, the user may select a type of wetting agent to apply to the media as provided by the wetting agent selection module (303), and a mode of deposition as provided by the deposition mode selection module (302).

In an example, selection of the deposition mode and the wetting agent may be performed automatically by the printing device (350). In this example, the user may be prompted to indicate via the GUI (306) the type of media (150) the print data is to be printed on. The printing device (350) may then select the type of wetting agent (151) to use by executing the wetting agent selection module (303) to automatically select a type of wetting agent (151) to deposit on the media (150) based on the type of media (150) identified by the user. The printing device (350) may also select the mode of deposition of the wetting agent (151) on the media (150) based on the type of media (150) identified by the user. The printing device (350) may also consider the print data defining the text and graphics to be printed on the media (150) in determining which mode of deposition of the wetting agent to use as the print data defines how much the printing fluid (153) deposited by the printhead (152) will effect the potential for deformation of the media (150).

In one example, the type of wetting agent (151) may be user-selectable from the GUI (306) at the inception of a print job. Further, in one example, information encoded by a DFE may be automatically selected as part of print job characteristic control bits that are passed from the DFE to the rest of the printing system. This may give the customer a user-selectable option to combat media issues on types of print jobs that are known to be prone to media deformation.

Figure 12:
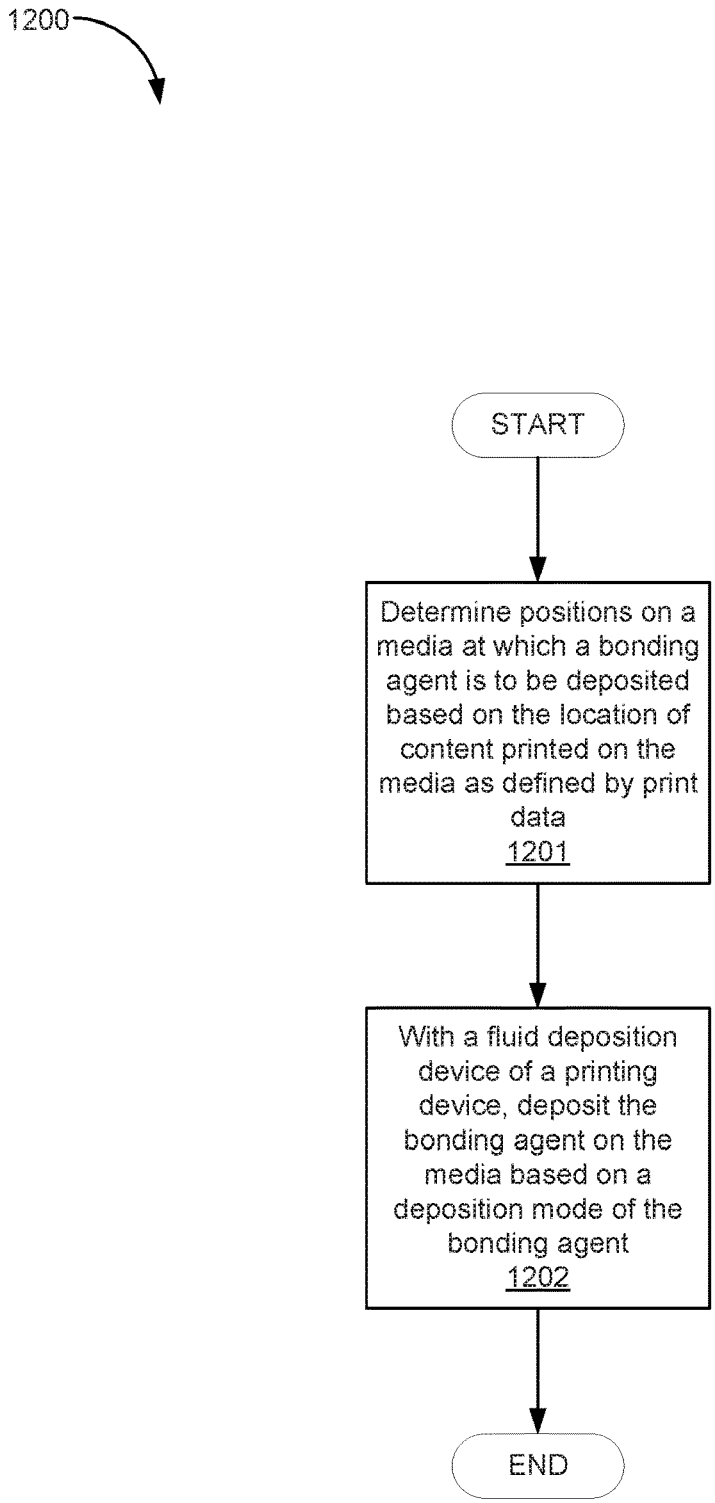
FIG. 12 is a flowchart showing a method of inhibiting media deformation, according to an example of the principles described herein.

FIG. 12 is a flowchart showing a method (1200) of inhibiting media (150) deformation, according to an example of the principles described herein. The method (1200) may include, determining (block 1201) positions on a media (150) at which a wetting agent (151) is to be deposited based on the location of content printed on the media (150) as defined by print data. In an example, the positions as to where the wetting agent (151) may be deposited on the media (150) may be based on the type of media (150) being printed on, the mode of wetting agent (151) deposition, and the type of wetting agent (151) selected for deposition, as well as the location of the content printed on the media (150).

The method may also include, with a fluid deposition device (100, 100-1, 100-2) of a printing device (350), depositing (block 1202) the wetting agent (151) on the media (150) based on a deposition mode of the wetting agent (151). The modes of deposition of the wetting agent (151) include, for example, application of the wetting agent (151) under printed portions of the media (150), application of the wetting agent (151) in portions of the media (150) where the printed portions are do not exist, flood coating of the wetting agent (151), application of the wetting agent (151) under printed portions of the media (150) using blooming function, application of the wetting agent (151) under printed portions of the media (150) using a blooming function, varying the amounts of wetting agent (151) applied to the media (150) in any of the above examples, other wetting agent (151) deposition modes, and combinations thereof.

Figure 13:
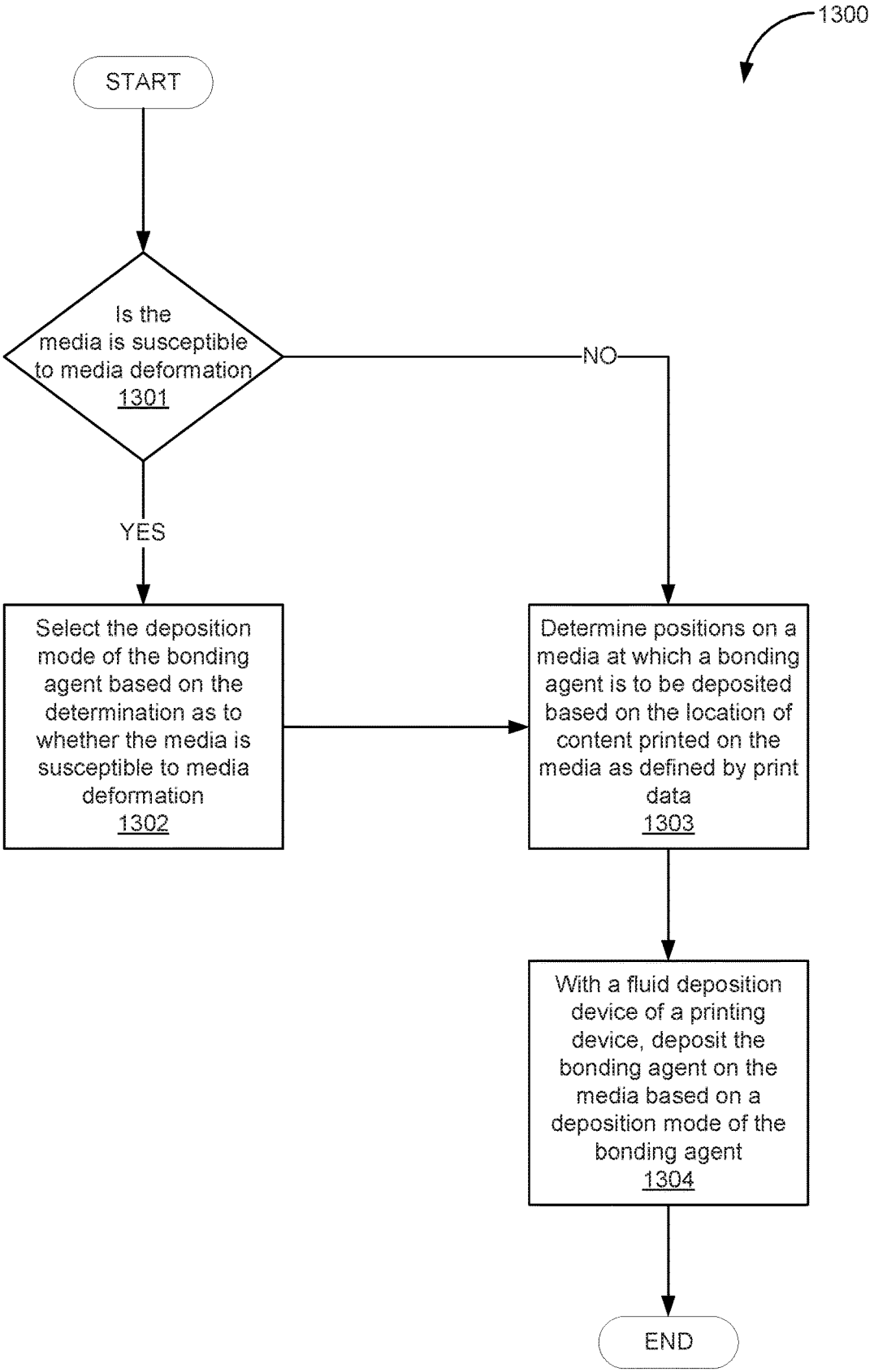
FIG. 13 is a flowchart showing a method of inhibiting media deformation, according to an example of the principles described herein.

FIG. 13 is a flowchart showing a method (1300) of inhibiting media deformation, according to an example of the principles described herein. the method (1300) of FIG. 13 may begin by determining (block 1301) whether the media is susceptible to media deformation. In response to the determination that the media (150) is not susceptible to media deformation (block 1301, determination NO), the printing device (350) may determine (block 1303) positions on the media (150) at which the wetting agent (151) is to be deposited based on the location of content printed on the media (150) as defined by print data.

In response to the determination that the media (150) is susceptible to media deformation (block 1301, determination YES), the printing device (350) may select (block 1302) the deposition mode of the wetting agent (151) based on the determination as to whether the media (150) is susceptible to media deformation. The method (1300) may then proceed to block 1303. With a fluid deposition device (100, 100-1, 100-2) of the printing device (350), the wetting agent (151) may be deposited (block 1304) on the media (150) based on a deposition mode of the wetting agent (151).

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general purpose computer, special purpose computer, or other programmable data processing apparatus to produce a machine, such that the computer usable program code, when executed via, for example, the processing device (101) of the printing device (350) or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The specification and figures describe a deposition module within a web press for inhibiting media deformation. The deposition module may include a fluid deposition device located on a side of a media, and a processing device to control the fluid deposition device to selectively apply a wetting agent to the media. The deposition of the wetting agent may be based on the location of content printed on the media as defined by print data.

The systems and methods described herein provide for the addition of moisture that assists in reducing, eliminating, or inhibiting differential expansion of the media that may otherwise lead to deformation of the media. The systems and methods described herein do not use additional color plane data from the DFE or additional print bars on the press which may detrimentally impact the speed at which a user may run using existing hardware.

The preceding description has been presented to illustrate and describe examples of the principles described. This description is not intended to be exhaustive or to limit these principles to any precise form disclosed. Many modifications and variations are possible in light of the above teaching.

What is claimed is:

1. A deposition module within a web press for inhibiting media deformation, comprising:

a fluid deposition device located upstream of a printhead on a side of a media; and a processing device to control the fluid deposition device to selectively apply a wetting agent to portions of the media where the content is not printed on the media and where the content is printed on the media;

wherein the deposition of the wetting agent is based on the location of content to be printed on the media by the printhead as defined by print data, wherein the wetting agent is applied where the content is printed to form a treated silhouette of the wetting agent around the content when selectively in a first mode based on a function, and wherein the wetting agent is applied where the content is not printed to leave an untreated silhouette around the content when selectively in second mode based on an inverted function.

2. The deposition module of claim 1, wherein:

the fluid deposition device comprises two fluid deposition devices, and the fluid deposition devices are located on opposite sides of the media.

3. The deposition module of claim 1, wherein the fluid deposition device is a thermal inkjet printhead or a piezoelectric printhead.

4. The deposition module of claim 1, wherein the processing device is programmed with a blooming function to expand an area where the wetting agent is applied underneath printing to be applied to the media as defined by the print data.

5. The deposition module of claim 1, wherein the wetting agent is a precursor that conditions the media to receive one or more colorants from the printhead.

6. The deposition module of claim 1, wherein the wetting agent comprises a salt to interact with pigments deposited by the printhead.

7. The deposition module of claim 1, further comprising a deposition mode selection module to select one of a plurality of different deposition modes of the wetting agent by the fluid deposition device based on the print data.

8. The deposition module of claim 1, wherein:

the printhead is to print both text and graphics as defined by the print data; and the fluid deposition device is to deposit more wetting fluid in portions of the media where the text is to be printed than where the graphics are to be printed.

9. The deposition module of claim 1, wherein:

the printhead is to print both text and graphics as defined by the print data; and the fluid deposition device is to deposit less wetting fluid in portions of the media where the graphics are to be printed than where the text is to be printed.

10. A deposition module for a web press for inhibiting media deformation, comprising:

a fluid deposition device located on a side of a media; and a processing device to control the fluid deposition device to selectively apply a wetting agent to the media;

wherein the deposition of the wetting agent is based on the location of content printed on the media as defined by print data;

wherein the processing device controls the fluid deposition device to selectively apply the wetting agent to portions of the media based on blooming where the content is and is not printed as defined by the print data, wherein the wetting agent is applied where the content is printed to form a treated silhouette of the wetting agent around the content when selectively in a first mode based on a blooming function, and wherein the wetting agent is applied where the content is not printed to leave an untreated silhouette around the content when selectively in second mode based on an inverted blooming function.

11. The deposition module of claim 10, wherein the processing device controls the fluid deposition device to selectively apply the wetting agent to portions of the media where the content is not printed on the media and where the content is printed on the media, and wherein the amount of wetting agent deposited on the media where the content is not printed is different from the amount of the wetting agent where the content is printed.

12. The deposition module of claim 10, wherein the processing device controls the fluid deposition device to apply the wetting agent to a whole frame as defined by the print data.

13. The deposition module of claim 10, wherein the amount of the wetting agent dispensed by the fluid deposition device is variable.

14. The deposition module of claim 10, comprising a wetting agent selection module to select a wetting agent for deposition.

15. The deposition module of claim 10, wherein the fluid deposition device is a thermal inkjet printhead or a piezoelectric printhead.

16. A method of inhibiting media deformation with a deposition module within a web press for inhibiting media deformation, the deposition module comprising:

a fluid deposition device located upstream of a printhead on a side of a media; and a processing device to control the fluid deposition device to selectively apply a wetting agent to the media;

wherein the deposition of the wetting agent is based on the location of content to be printed on the media by the printhead as defined by print data, the method comprising:

determining positions on the media at which the wetting agent is to be selectively deposited to portions of the media where the content is not printed on the media and where the content is printed on the media based on the location of content to be printed on the media as defined by the print data, wherein the wetting agent is applied where the content is printed to form a treated silhouette of the wetting agent around the content when selectively in a first mode based on a function, and wherein the wetting agent is applied where the content is not printed to leave an untreated silhouette around the content when selectively in second mode based on an inverted function; and with the fluid deposition device of the web press, depositing the wetting agent on the media based on a deposition mode of the wetting agent.

17. The method of claim 16, comprising:

determining from the intended printed content whether the media is susceptible to media deformation; and selecting the deposition mode of the wetting agent based on the determination as to whether the media is susceptible to media deformation.

18. The deposition module of claim 2, wherein the two fluid deposition devices apply the wetting agent to a side of the media that is to have little or no printed content thereon.

* * * * *